United States Patent [19]

Seale et al.

[11] Patent Number: 4,995,840

[45] Date of Patent: Feb. 26, 1991

[54] STABILIZING FIN FOR A MOTOR BOAT

[75] Inventors: Robert Seale, Peekskill; Dennis Rizzuto, Spring Valley; Harold Satin, New City, all of N.Y.

[73] Assignee: Hydrofoil International, Inc., Crompond, N.Y.

[21] Appl. No.: 389,497

[22] Filed: Aug. 4, 1989

[51] Int. Cl.[5] ..... B63H 1/18

[52] U.S. Cl. ..... 440/66; 114/274; 440/900

[58] Field of Search ..... 114/274; 440/66, 76, 440/77, 78, 900

[56] References Cited

U.S. PATENT DOCUMENTS

| | | | |
|---|---|---|---|
| 1,226,400 | 5/1917 | Smith . | |
| 1,467,641 | 9/1923 | Johnson . | |
| 1,549,564 | 8/1925 | Slocum . | |
| 1,559,616 | 11/1925 | Johnson et al. . | |
| 1,574,977 | 3/1926 | Johnson et al. . | |
| 1,576,237 | 3/1926 | Dawson . | |
| 1,716,962 | 6/1929 | Johnson . | |
| 1,734,911 | 11/1929 | King et al. | 440/66 |
| 1,763,970 | 6/1930 | Johnson . | |
| 2,274,200 | 2/1942 | Hill | 114/66.5 |
| 2,319,640 | 5/1943 | Sink | 115/42 |
| 2,551,371 | 5/1951 | Grigg | 115/17 |
| 2,705,468 | 4/1955 | Dix | 115/18 |
| 2,773,467 | 12/1956 | Bailey | 114/66.5 |
| 2,787,974 | 4/1957 | Johnson | 115/18 |
| 2,860,594 | 11/1958 | Kiekhaefer | 115/17 |
| 2,955,559 | 10/1960 | Palmer et al. | 114/66.5 |
| 2,959,148 | 11/1960 | Canazzi | 115/15 |
| 2,963,000 | 12/1960 | Fester | 115/42 |
| 2,998,795 | 9/1961 | Downie | 114/145 |
| 3,065,723 | 11/1962 | Tulin | 114/274 |
| 3,099,240 | 7/1963 | Montague | 114/66.5 |
| 3,114,343 | 12/1963 | Headrick et al. | 114/66.5 |
| 3,139,853 | 7/1964 | McCarthy et al. | 115/17 |
| 3,211,119 | 10/1965 | Kiekhaefer | 114/66.5 |
| 3,343,512 | 9/1967 | Rasmussen | 114/66.5 |
| 3,357,390 | 12/1967 | Wray | 114/274 |
| 3,433,195 | 3/1969 | Poole | 114/274 |
| 3,939,795 | 2/1976 | Rocka | 440/78 |
| 3,955,527 | 5/1976 | Holtermann | 440/66 |
| 4,070,983 | 1/1978 | Randall | 440/66 |
| 4,304,557 | 12/1981 | Henrich | 440/66 |
| 4,487,152 | 12/1984 | Larson | 114/274 |

FOREIGN PATENT DOCUMENTS

| | | | |
|---|---|---|---|
| 0103245 | 6/1936 | Australia . | |
| 0275818 | 12/1964 | Australia . | |
| 447718 | 4/1948 | Canada | 440/66 |
| 48-17891 | 2/1973 | Japan . | |
| 0716879 | 10/1954 | United Kingdom . | |
| 0738333 | 10/1955 | United Kingdom . | |
| 0857394 | 12/1960 | United Kingdom . | |
| 0992375 | 5/1965 | United Kingdom . | |
| 0994320 | 6/1965 | United Kingdom . | |
| 1369710 | 10/1974 | United Kingdom . | |

OTHER PUBLICATIONS

Barron, Jim, Whale Tail, Sting Ray and Doel-Fin Claim Numerous Benefits -Here's How They Really Work, Trailer Boats, Jan. 1989 pp. 61-63, 166.

*Primary Examiner*—Sherman Basinger
*Assistant Examiner*—Thomas J. Brahan
*Attorney, Agent, or Firm*—Kenyon & Kenyon

[57] ABSTRACT

Each stabilizing fin is provided with a thickened trailing edge in order to act as a flap for inducing drag during start-up. The induced drag serves to minimize the time within which the fin moves into a planing position. The recess on the bottom surface of the fin enhances the lifting force on the fin during stabilization without imposing undue drag forces during high speed travel of a boat.

12 Claims, 3 Drawing Sheets

10
11
12
13
14
15
16
17
18
20
21
22
23
24
30
4

STABILIZING FIN FOR A MOTOR BOAT

This invention relates to a stabilizing fin for a motor boat.

Heretofore, various types of stabilizers have been known for mounting, for example, on a motor post of an outboard motor in order to stabilize a motor boat during start-up. For example, U.S. Pat. No. 4,487,152 describes a stabilizer of generally delta shape intended to apply a lifting force to the stern of a boat and a downward force on the bow of the boat. The purpose of such a stabilizer is to enable the boat to plane more quickly after getting underway. In order to mount such a stabilizer on a motor post, a groove is provided centrally of the stabilizer to permit the stabilizer to fit about the post while a slot communicates with the groove in order to receive a relatively thin cavitation plate mounted on the motor post. However, due to the variety of sizes of motor posts, any given stabilizer may fit about only a relatively few of such motor posts.

Other types of stabilizers have also been known which can be attached to the cavitation plate or plates of an outboard motor or a stern drive. For example, a published article appearing in "Trailer Boats" magazine dated January 1989, beginning on page 61 describes a product being sold under the trade name "Whale Tail" as "a flat plate without the shape of a foil" and of one piece construction, the product being described as bolted under the trailing end of a cavitation plate. The "Trailer Boats" article also describes a product being sold under the trade name "Doel-fin" as having two separate "wings" of "foil shape" which slide over and bolt to a "cavitation plate". Another product sold under the trade name of "Doel-fin" which is not shown in the mentioned "Trailer Boats" article is a one-piece stabilizer as described in U.S. Pat. No. 4,487,152 with a nose section in front of the motor post. Still another product which is described in the mentioned "Trailer Boats" article is a product sold under the trade name "Sting Ray" which the article describes as having a "hydrofoil" shape and one piece construction, and being bolted to the rear of a "cavitation plate" to extend to the rear. Further, products have been sold under the trade name "Spar Stabilizer" which are one piece plates which are flat and of a generally delta wing planform and are screwed to the "cavitation plate" or plates and, in one model, have a nose portion which extends in front of the motor post and in another model do not.

In addition, the stabilizers which have been used generally have a cross-sectional shape wherein a leading edge extends in a tapered manner to a relatively thin trailing edge. In this respect, the shape of the stabilizer has been such as to reduce drag during movement through a body of water, for example in the manner of an airplane wing or other hydrofoil.

Accordingly, it is an object of the invention to provide a stabilizing fin for a motor boat which can be universally connected to various sizes of motor posts.

It is another object of the invention to improve the lifting force of a stabilizing fin on a motor boat.

It is another object of the invention to provide stabilizing fins which can be rapidly connected to cavitation plates on a motor post.

Briefly, the invention provides a stabilizing fin for a motor boat which is of a generally triangular shape and which is provided on a mounting side with a longitudinally extending slot for mounting on a cavitation plate on a motor post of an outboard motor. Suitable means are also provided for removably securing the fin to the cavitation plate. For example, a pair of bolts may be provided for passage through suitable openings in the mounting side of the fin and corresponding openings in the cavitation plate.

The fin also has a second side which extends angularly from the mounting side in order to provide a tapered leading edge as well as a third side which extends perpendicularly from the mounting side and which has a thickened trailing edge. For example, the thickened trailing edge is of a cross-sectional shape to induce drag, for example, the trailing edge may be of wedge-shaped cross-section. In addition, a recess is provided in the bottom surface of the fin which extends between the leading edge and the trailing edge.

The stabilizing fins are used in pairs with each fin being mounted on an opposite side of a motor post. To this end, each fin has a slot which is sized to slidably receive a cavitation plate extending laterally from the motor post.

During start-up of the motor, the boat on which the motor is mounted is initially driven forward, for example, by action of a propeller mounted at the lower end of the motor post as is known. At this time, the bow of the boat normally lifts out of the water while the stern sinks lower into the water. However, as the boat begins to move through the water, the stabilizing fins increase the lifting force on the stern of the boat so that the bow becomes lowered into the water, thus, achieving a "planning" position. In this respect, due to the shape of the trailing edges of the fins, a relatively large lifting force is imposed on the stern of the boat. That is, because the trailing edge of each fin is thickened, each edge acts in the manner of a flap to increase the drag force on the fin. As a result, the drag force tends to pivot the fin in a direction so that the leading edge is returned toward the initial horizontal position. At the same time, the recess in the bottom surface of each fin serves to space the bottom of the fin from the surface of the water passing underneath each fin. This, in turn, lowers the drag resistance of a fin to high speed travel.

These and other objects and advantages of the invention will become more apparent from the following detailed description taken in conjunction with the accompanying drawings wherein.

Figures 1, 2:
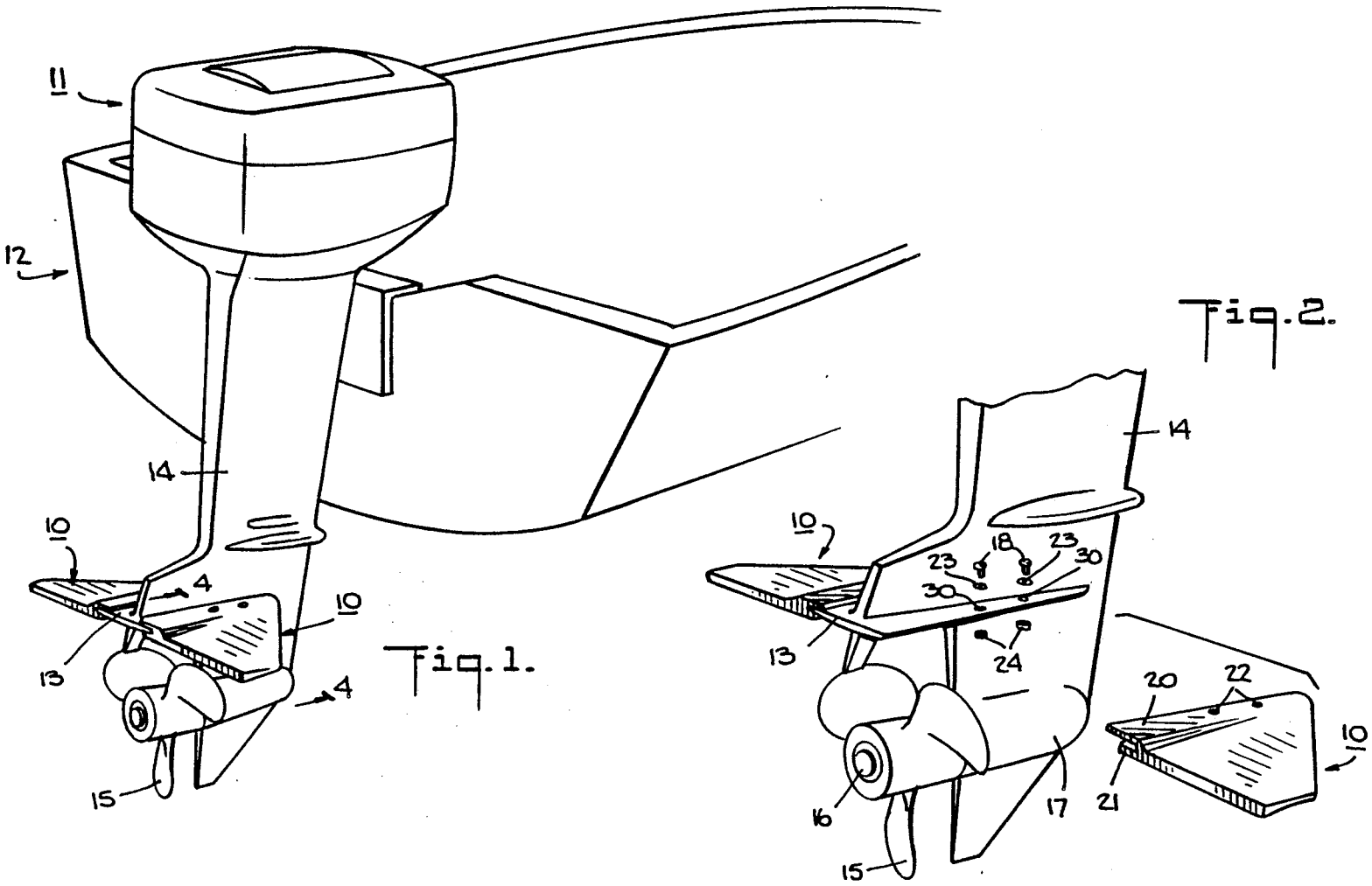
FIG. 1 illustrates a perspective view of a pair of stabilizing fins in accordance with the invention mounted on an outboard motor of a motor boat.
FIG. 2 illustrates a partial exploded view of a mounting arrangement of a stabilizing fin of a cavitation plate in accordance with the invention.

Referring to FIG. 1, a pair of stabilizing fins 10 are mounted on an outboard motor 11 which, in turn, is mounted in a conventional fashion at the rear of a boat 12. As indicated, the stabilizing fins 10 are mounted on a cavitation plate 13 which extends laterally of a post 14 of the motor 11 above a propeller 15 as is known.

Referring to FIG. 2, the propeller 15 is mounted on a shaft 16 which extends into and is rotatably mounted in a hub 17 formed at a lower end of the motor post 14. Each fin 10 is removably secured by suitable means, such a pair of bolts 18 to the cavitation plate 13.

Figure 3:
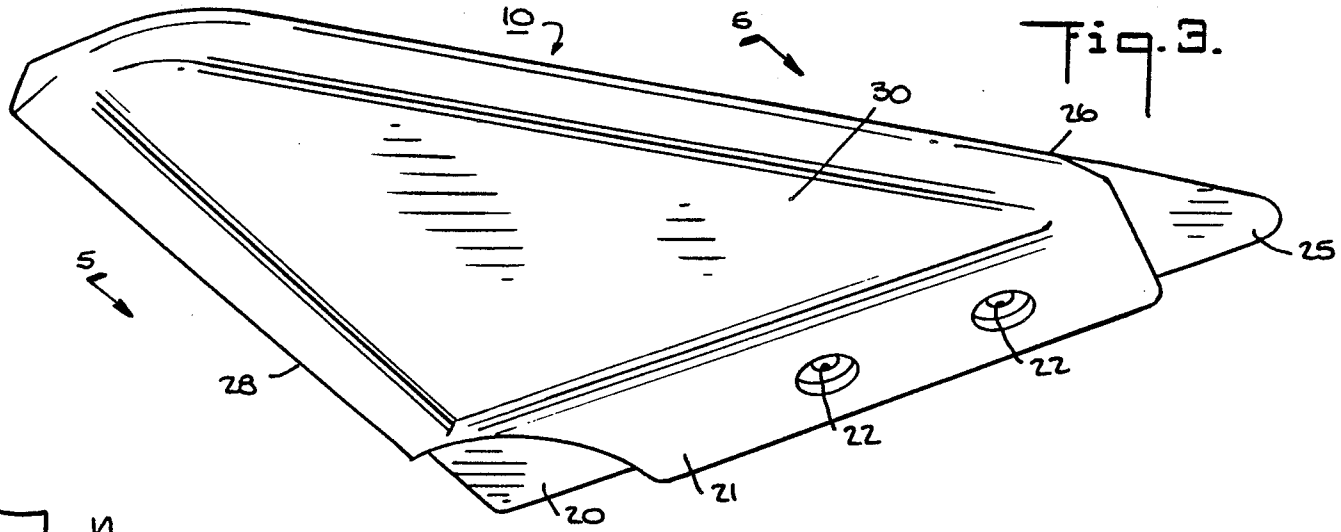
FIG. 3 illustrates a bottom perspective view of a stabilizing fin constructed in accordance with the invention.
Figure 4:
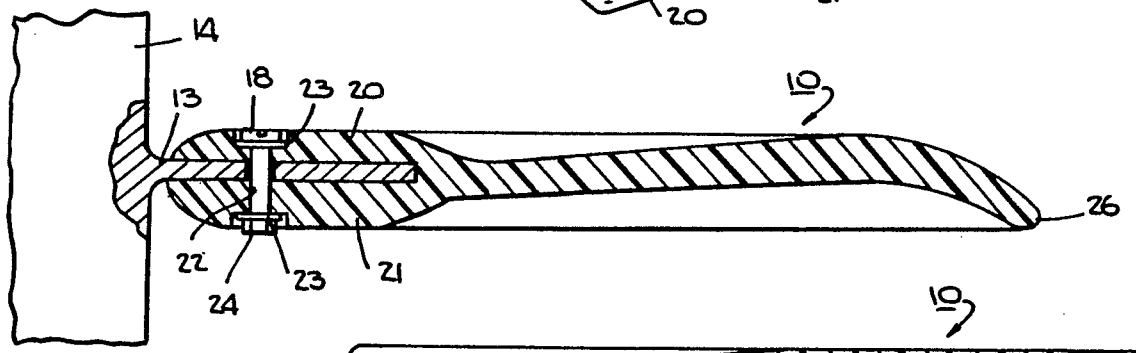
FIG. 4 illustrates a view taken on line 4—4 of FIG. 1.

Referring to FIG. 3, each stabilizing fin 10 is of generally triangular shape with a mounting side provided with a longitudinally extending slot 19 (see FIG. 4) defined by a pair of longitudinally extending flanges 20, 21 for slidably receiving the cavitation plate 13. In addition, each flange 20, 21 is provided with a pair of counter-bored openings 22 which extend on axes perpendicular to the slot 19 and the cavitation plate 13.

Each pair of aligned openings 22 receives a bolt 18, a pair of washers 23 and a nut 24 threaded onto an end of the bolt 18. As indicated, the head of the bolt 18 and the nut 24 are recessed within the openings 22.

Referring to FIG. 3, the upper flange 20 has a triangular forward portion 25 which extends forwardly beyond the lower flange 21 so as to sit in overlying relation to the cavitation plate 13.

Figure 5:
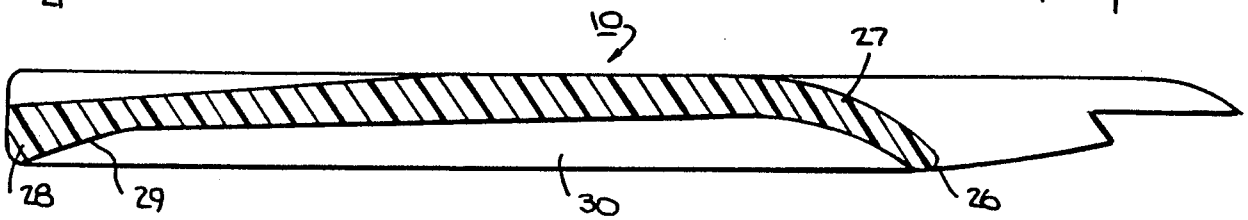
FIG. 5 illustrates a view taken on line V—V of FIG. 3.

Referring to FIGS. 3 and 5, each fin 10 has a leading side which extends angularly of the mounting side and which has a tapered leading edge 26. As indicated in FIG. 5, the leading side has a curvilinear upper surface 27 which extends from the leading edge 26 in order to direct a flow of water thereover.

Each fin 10 also has a trailing side which extends perpendicularly from the mounting side and which has a thickened trailing edge 28, for example, of wedge-shaped cross-section as indicated in FIG. 5. In addition, a recess 30 of triangular shape (see FIG. 3) is disposed in the bottom surface of each fin 10 and extends between the leading edge 26 and the thickened trailing edge 28.

Figure 7:
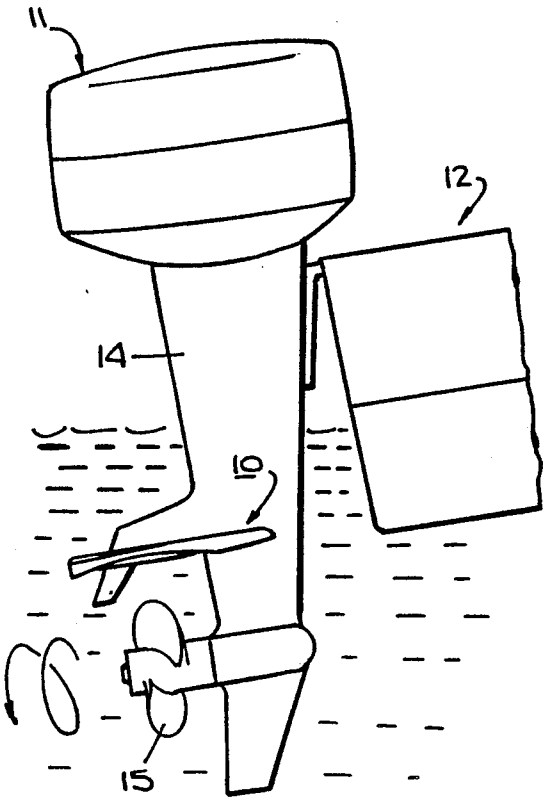
FIG. 7 illustrates a stabilizing fin in a position at the time of start-up of a motor boat.

As indicated in FIG. 5, the trailing edge 28 has an inside surface 29 which forms an angle of 30° relative to a horizontal plane, as viewed. The purpose of the thickened trailing edge 28 is to increase the pressure on the underside of the fin 10 when the fin 10 is in a steep angle of attack position as occurs on start-up, for example, as indicated in FIG. 7. By increasing the pressure on the underside of the fin 10 at this time, the lift is increased. Of note, the steep angle of attack of the fin 10 may also occur when the boat accelerates, otherwise known as being "in the hole".

Figure 8:
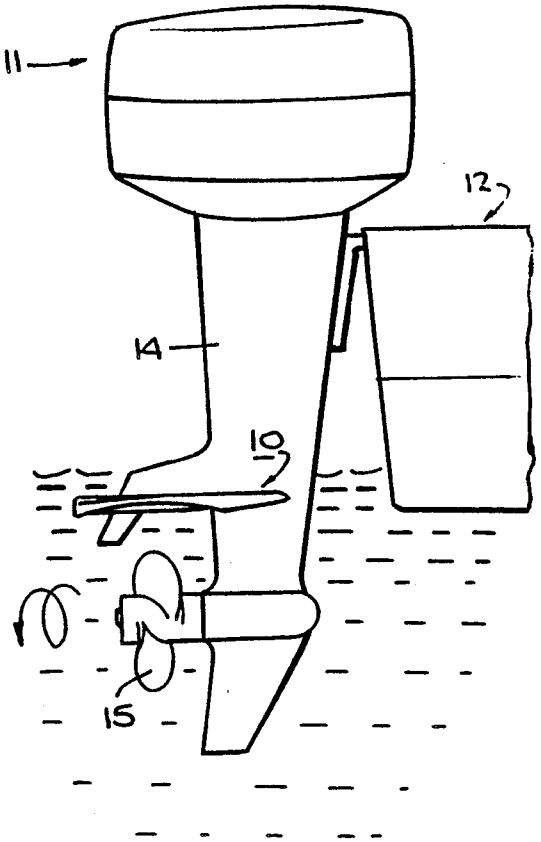
FIG. 8 illustrates a stabilizing fin in a position after start-up of a motor boat.

Referring to FIG. 3, the recess or depression 30 on the underside of the fin 10 has a depth which ranges from zero at the outer edge (to the left as viewed in FIG. 3) to one quarter inch at the deepest point. This recess 30 has two functions. First, when the fin 10 is at a steep angle of attack, the recess 30 contributes to raising the water pressure on the underside of the fin 10 in order to funnel the water into the deepest point of the recess 30 so as to increase the lift on the fin 10. The second function is to decrease the drag on the trailing edge 28. This occurs when the fin 10 is at its shallowest attack angle. This position of the fin 10 is the position when the boat is on plane, for example, as indicated in FIG. 8. This is achieved by the leading edge breaking the surface tension of the water. Upon flowing back under the fin 10, the water comes in contact with the recess 30. The recess inhibits the water from forming drag along the bottom side of the fin 10 and the trailing edge 28 by cavitation. This decreases the drag associated with the depending trailing edge 28.

Referring to FIG. 2, in order to mount a fin 10 on the cavitation plate 13, the openings 22 in the mounting side of the fin 10 are aligned with corresponding openings 30 in the plate 13. Thereafter, the washers 23 are placed in the respective openings 22 and the bolts 18 passed through the flanges 20, 21 and plate 13 into threaded relation with the nuts 24. In this way, each fin 10 is removably mounted on the cavitation plate 13.

Figure 6:
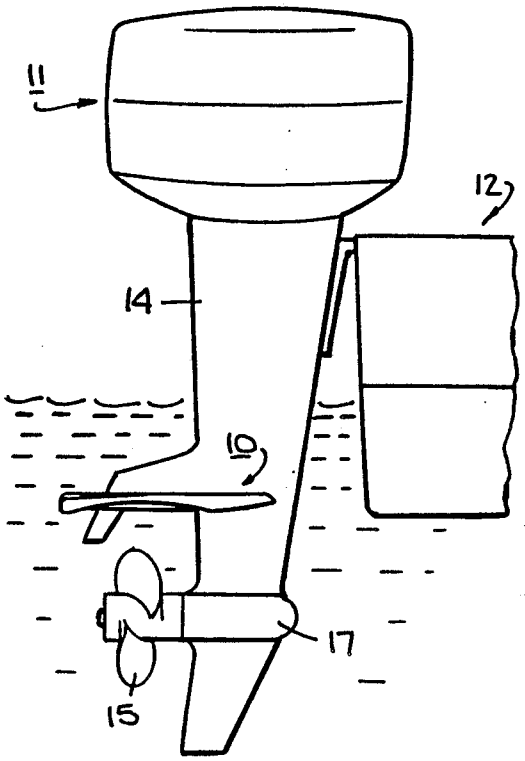
FIG. 6 illustrates a stabilizing fin in a static position prior to start-up of a motor boat.

Referring to FIG. 6, prior to start-up of the motor 11 the post 14 is in a generally vertical position while each fin 10 is in a generally horizontal position, for example corresponding to a position as shown in FIG. 5. As the motor 11 is started, the propeller 15 begins to rotate whilst creating a thrust force driving the boat 12 forwardly. During this start-up time, the stabilizing fin 10 is pivoted into the position shown in FIG. 7, that is, the leading edge 26 lifts relative to the trailing edge 28 so that the fin 10 is angularly disposed relative to a horizontal plane. At this time, the trailing edge 28 acts as a drag-inducing flap such that a lifting force is applied to the trailing edge 28 causing the fin 10 to rotate in a clockwise manner, as viewed, into a position as shown in FIG. 8. That is, the fin 10 is rotated towards a horizontal plane.

As indicated in FIG. 2, a pair of stabilizing fins 10 can be mounted on any suitably sized cavitation plate 13 which extends from a motor post 14 irrespective of the shape and/or size of the motor post 14 on which the plate 13 is mounted.

Referring to FIGS. 5 and 8, during movement of a fin 10 through the water, the leading edge 26 permits a high speed to be obtained without inducing any significant drag force on the fin 10. In this respect, the shape of the leading edge 26 and the curvilinear upper surface 27 and the recess 30 permit the water to flow in a laminar fashion over the upper surface while flowing in a turbulent fashion along the bottom surface. In this respect, any separation of the water flow from the bottom surface, that is from the surface of the recess 30, provides little cavitation. On the other hand, a separation of the water flow from the bottom surface of the fin 10 reduces the drag forces therebetween.

The invention thus provides a stabilizing fin which can be readily mounted on motor posts of different sizes. Further, the invention provides a stabilizing fin which is able to increase the lift on the stern of a boat during start-up so as to achieve planning of the boat in a minimum of time.

What is claimed is:

1. A stabilizing fin for a motor boat comprising
   - a first side having a longitudinally extending slot for mounting on a cavitation plate on a motor post;
   - a second side extending angularly of said first side and having a tapered leading edge;
   - a trailing side extending perpendicularly from said first side and having a thickened trailing edge; and
   - a recess in a bottom surface extending between said leading edge and said thickened trailing edge.

2. A stabilizing fin as set forth in claim 1 wherein said second side has a curvilinear upper surface extending from said leading edge to direct a flow of water thereover.

3. A stabilizing fin as set forth in claim 2 wherein said trailing edge is of wedge-shaped cross-section.

4. A stabilizing fin as set forth in claim 2 wherein said recess is of triangular shape.

5. A stabilizing fin as set forth in claim 1 which further comprises a pair of openings along said first side for receiving a pair of mounting bolts therein.

6. In combination, a motor post for an outboard motor;

a cavitation plate extending laterally of said post;

a pair of stabilizing fins removably mounted on said cavitation plate, each said fin having a slot on one side slidably receiving said cavitation plate, a tapered leading edge extending angularly of said one side, a thickened drag-inducing trailing edge and a recess in a bottom surface extending between said leading edge and said trailing edge; and means for removably securing each fin to said plate.

7. The combination as set forth in claim 6 wherein each fin has a curvilinear upper surface extending from said leading edge.

8. The combination as set forth in claim 7 wherein said trailing edge is of wedge-shaped cross-section.

9. The combination as set forth in claim 7 wherein said recess is of triangular shape.

10. The combination as set forth in claim 6 wherein said means includes a pair of bolts securing each fin to said plate.

11. The combination as set forth in claim 6 wherein each fin is made of plastic.

12. The combination as set forth in claim 6 wherein each fin has a pair of longitudinally extending flanges defining said slot therebetween, one of said flanges having a triangular forward portion extending forwardly beyond the other of said flanges in overlying relation to said cavitation plate.

* * * * *